US008937851B2

(12) United States Patent
Matsuo et al.

(10) Patent No.: US 8,937,851 B2
(45) Date of Patent: Jan. 20, 2015

(54) ELECTRONIC TIMEPIECE

(75) Inventors: Mitsuaki Matsuo, Fussa (JP); Hirofumi Nagareda, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 155 days.

(21) Appl. No.: 13/615,407

(22) Filed: Sep. 13, 2012

(65) Prior Publication Data

US 2013/0077448 A1 Mar. 28, 2013

(30) Foreign Application Priority Data

Sep. 27, 2011 (JP) ..... 2011-210169

(51) Int. Cl.
*G04B 19/22* (2006.01)
*G04C 11/02* (2006.01)
*G04R 20/12* (2013.01)

(52) U.S. Cl.
CPC ..... *G04R 20/12* (2013.01)
USPC ..... 368/47; 368/21

(58) Field of Classification Search
USPC ..... 368/21, 47
See application file for complete search history.

(56) References Cited

U.S. PATENT DOCUMENTS

| | | | | |
|---|---|---|---|---|
| 6,219,302 | B1 * | 4/2001 | Tanoguchi et al. | 368/47 |
| 7,680,485 | B2 * | 3/2010 | Takada | 455/411 |
| 7,948,832 | B1 * | 5/2011 | Luo et al. | 368/21 |
| 8,331,200 | B1 * | 12/2012 | Luo et al. | 368/21 |
| 8,385,156 | B2 | 2/2013 | Ozawa | |
| 2005/0286347 | A1 * | 12/2005 | Irino | 368/21 |
| 2007/0201311 | A1 * | 8/2007 | Olson | 368/29 |
| 2008/0212413 | A1 * | 9/2008 | Pikula et al. | 368/47 |
| 2009/0135675 | A1 * | 5/2009 | Akiyama | 368/14 |
| 2009/0274011 | A1 * | 11/2009 | Fujisawa | 368/47 |
| 2011/0051559 | A1 * | 3/2011 | Oh | 368/10 |
| 2011/0216628 | A1 * | 9/2011 | Nalla et al. | 368/21 |
| 2011/0280108 | A1 * | 11/2011 | Honda | 368/21 |

FOREIGN PATENT DOCUMENTS

| | | | |
|---|---|---|---|
| CN | 101208638 | A | 6/2008 |
| JP | 54-074473 | A | 6/1979 |
| JP | 7-027881 | A | 1/1995 |
| JP | 2000-171576 | A | 6/2000 |
| JP | 2004-191263 | A | 7/2004 |

OTHER PUBLICATIONS

Chinese Office Action dated May 15, 2014 in counterpart Chinese Application No. 201210364208.2.

* cited by examiner

*Primary Examiner* — Amy Cohen Johnson
*Assistant Examiner* — Matthew Powell
(74) *Attorney, Agent, or Firm* — Holtz, Holtz, Goodman & Chick PC

(57) ABSTRACT

An electronic timepiece includes: a radio-wave receiving unit; a time acquiring unit that acquires time information and daylight-saving-time implementation information; a storage unit that stores predetermined information associated with a time in a preset area; and a calculation unit that calculates a current time in the preset area, wherein the predetermined information includes daylight-saving-time setting information; and when the time of switching to/from daylight saving time comes during a radio-wave reception process, the calculation unit determines whether a first or second condition is satisfied, wherein the first condition is that radio-wave reception has failed; and the second condition is that the daylight-saving-time implementation information is information provided before the time of switching; and when the first or second condition is satisfied, the calculation unit switches the time to calculate current time.

20 Claims, 6 Drawing Sheets

FIG. 2

| CITY CODE | TIME DIFFERENCE | NAME OF CITY | RECEPTION SETTING | TRANSMITTING STATION | DST SETTING | INITIAL SETTING | STD→DST | DST→STD |
|---|---|---|---|---|---|---|---|---|
| LON | 0.0 | London | ON→ OFF | MSF60→ DCF77.5 | auto⇔ manual | auto | LAST SUNDAY OF MARCH: 1 O'CLOCK→2 O'CLOCK | LAST SUNDAY OF OCTOBER: 2 O'CLOCK→1 O'CLOCK |
| PAR | 1.0 | Paris | ON→ OFF | DCF77.5 →MSF60 | auto⇔ manual | auto | LAST SUNDAY OF MARCH: 2 O'CLOCK→3 O'CLOCK | LAST SUNDAY OF OCTOBER: 3 O'CLOCK→2 O'CLOCK |
| TYO | 9.0 | Tokyo | ON→ OFF | JJY40→ JJY60 | auto⇔ manual | auto | NO SETTING | NO SETTING |
| SYD | 10.0 | Sydney | NO SETTING | NO SETTING | auto⇔ manual | auto | FIRST SUNDAY OF OCTOBER: 2 O'CLOCK→3 O'CLOCK | FIRST SUNDAY OF APRIL: 3 O'CLOCK→2 O'CLOCK |
| LAX | -8.0 | Los Angeles | ON→ OFF | WWVB60 | auto⇔ manual | auto | SECOND SUNDAY OF MARCH: 2 O'CLOCK→3 O'CLOCK | FIRST SUNDAY OF NOVEMBER: 2 O'CLOCK→1 O'CLOCK |
| NYC | -5.0 | New York | ON→ OFF | WWVB60 | auto⇔ manual | auto | SECOND SUNDAY OF MARCH: 2 O'CLOCK→3 O'CLOCK | FIRST SUNDAY OF NOVEMBER: 2 O'CLOCK→1 O'CLOCK |

FIG. 4

| START OF RADIO WAVE RECEPTION | CODE RECEPTION | COMPLETION OF TIME CORRECTION | SWITCHING FLAG | DST FLAG | ADDITIONAL PROCESS |
|---|---|---|---|---|---|
| 56 MIN 30 SEC | 57-58 MIN | 59 MIN 10 SEC | OFF | OFF | NONE |
| 57 MIN 30 SEC | 58-59 MIN | 00 MIN 10 SEC | ON | OFF | SWITCHING FLAG "OFF", DST FLAG "ON", AND CORRECTING TIME |
| 58 MIN 30 SEC | 59-00 MIN | ERROR | ON | OFF | SWITCHING FLAG "OFF", DST FLAG "ON", AND CORRECTING TIME |
| 59 MIN 30 SEC | 00-01 MIN | 02 MIN 10 SEC | ON | ON | SWITCHING FLAG "OFF" |
| 00 MIN 30 SEC | 01-02 MIN | 03 MIN 10 SEC | OFF | ON | NONE |

ELECTRONIC TIMEPIECE

BACKGROUND OF THE INVENTION

1. Field of the Invention

The present invention relates to an electronic timepiece that automatically switches time associated with daylight saving time.

2. Description of Related Art

A conventional electronic timepiece can switch a displayed time to daylight saving time (also referred to as DST) while daylight saving time is in effect. For example, there has been an electronic timepiece equipped with a function to receive a radio wave including information of the standard time of a certain area (hereinafter referred to as "standard time radio wave") to correct time. Such an electronic timepiece can automatically acquire the information about whether daylight saving time is in effect in each area on the basis of a signal included in a time code signal transmitted from the transmitting station in each country.

In a case of a conventional electronic timepiece which needs to reduce power consumption, such as a wristwatch in particular, the standard time radio wave is received only once a day. Accordingly, there may be a case where a change to daylight saving time/standard time is not reflected in the time after the change, depending on the timing of receiving the standard time radio wave. In such a case, a user who is unfamiliar with daylight saving time, especially a person who lives in Japan, may not recognize that the time has already been changed to daylight saving time/standard time, resulting in a trouble. Even if the user recognizes the change to daylight saving time/standard time, it may be difficult for the user to manually switch the settings of the timepiece. In view of these circumstances, Japanese Unexamined Patent Application Publication No. 2000-171576 discloses a technique to acquire from JJY the information of preliminary notice that he time will be switched to daylight saving time/standard time. In this technique, on a day on which the time is switched to daylight saving time/standard time, the standard time radio wave is received twice, i.e., before and after the switching. On the other hand, Japanese Unexamined Patent Application Publication No. 2004-191263 discloses a technique to make the reception time of the standard time radio wave different between the period of daylight saving time and the period of standard time, so that the standard time radio wave is received immediately after the switching in each period.

On the other hand, there has been an electronic timepiece that stores therein in advance a table providing information of times and dates of start and end of daylight saving time for each city, the local time of which can be displayed with the electronic timepiece. Japanese Unexamined Patent Applications Publication No. 54-74473 and No. 7-27881 disclose an electronic timepiece that acquires implementation period of daylight saving time from a table. This electronic timepiece is automatically set forward one hour during the period of daylight saving time.

A conventional way of receiving the standard time radio wave, however, changes the time of receiving the standard time radio wave irrespective of convenience and intention of a user. Further, since switching between daylight saving time and standard time is performed at a different time depending on the city, the time of receiving the standard time radio wave is changed every time the user moves to another city, which is inconvenient. Furthermore, since it takes a few minutes to complete reception of the standard time radio wave, the switching may coincide with reception of the standard time radio wave if the reception time of the standard time radio wave is arbitrarily set. This may provide a user with inaccurate information.

SUMMARY OF THE INVENTION

The present invention provides an electronic timepiece that can make settings for daylight saving time easily and properly without complicating the control for reception of the standard time radio wave.

According to an aspect of the present invention, there is provided an electronic timepiece including: a receiving unit that receives a standard time radio wave; a time acquiring unit that acquires time information and daylight-saving-time implementation information indicating whether daylight saving time is currently in effect, from the standard time radio wave received by the receiving unit; a time setting storage unit that stores predetermined information associated with a time in a preset area; and a calculation unit that calculates a current time in the preset area based on the time information and the daylight-saving-time implementation information acquired by the time acquiring unit and based on the predetermined information stored in the time setting storage unit, wherein the predetermined information stored in the time setting storage unit includes daylight-saving-time setting information indicating a time of switching associated with a start and end of the daylight saving time in the preset area; and (i) when the time of switching comes while a process for receiving the standard time radio wave is being performed, (ii) the calculation unit determines whether one of a first condition and a second condition is satisfied, wherein the first condition is that reception of the standard time radio wave fails after completion of the process for receiving the standard time radio wave; and the second condition is that the daylight-saving-time implementation information acquired by the time acquiring unit is information provided before the time of switching; and (iii) when one of the first condition and the second condition is satisfied, the calculation unit makes a switch associated with whether the daylight saving time is in effect, to calculate the current time.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 2 illustrates a table to make settings for daylight saving time (hereinafter referred to as a daylight-saving-time setting table);

FIG. 4 explains operations and settings of when radio-wave reception process is performed immediately before or after the start of daylight saving time;

DESCRIPTION OF THE PREFERRED EMBODIMENTS

An embodiment of the present invention is described below with reference to the attached drawings.

Figure 1:
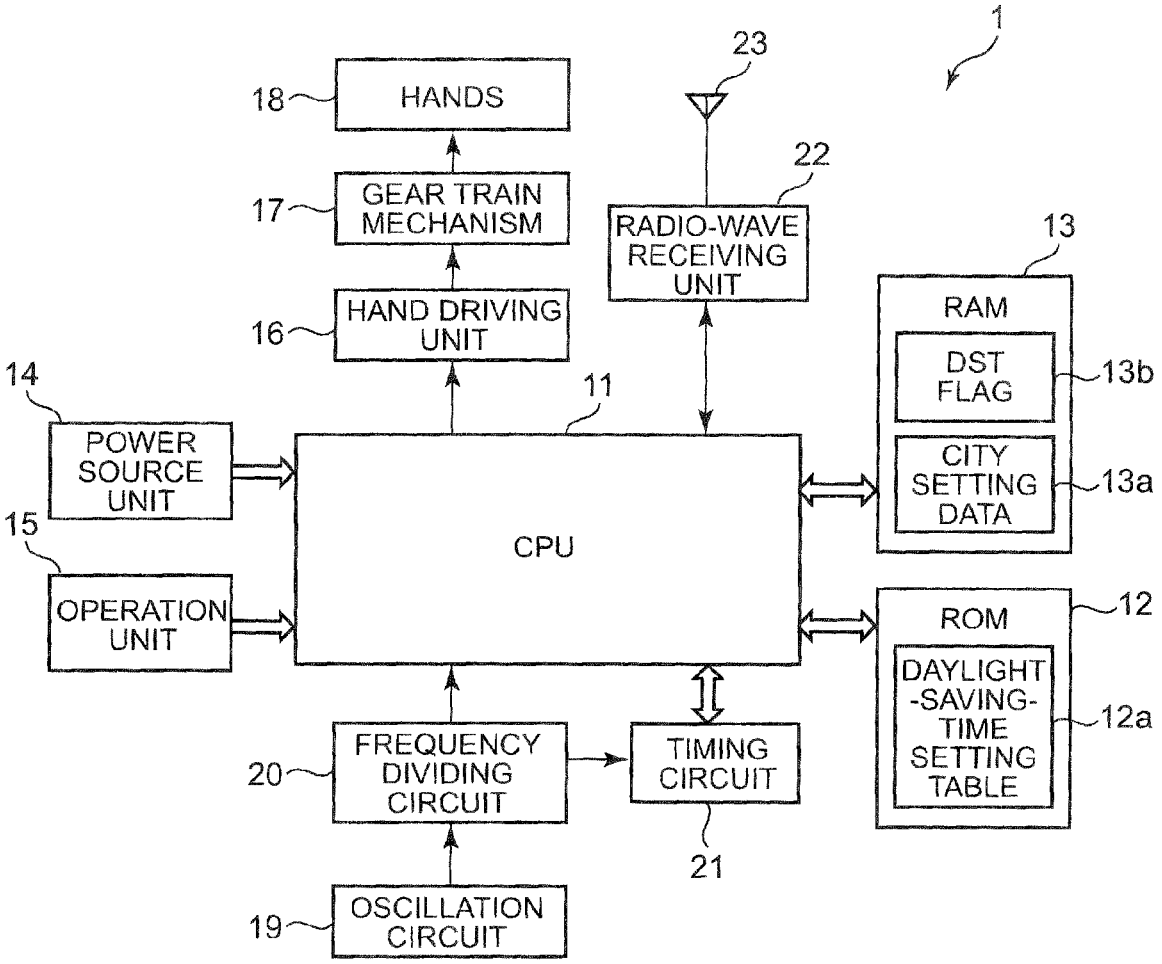
FIG. 1 is a block diagram illustrating an internal configuration of an electronic timepiece according to an embodiment of the present invention.

FIG. 1 is a block diagram illustrating an internal configuration of an electronic timepiece according to an embodiment of the present invention.

An electronic timepiece 1 according to the present embodiment is capable of receiving a standard time radio wave and automatically correcting time. The electronic timepiece 1 in the embodiment is an analog wristwatch that displays time with hands, but is not particularly limited thereto.

The electronic timepiece 1 includes a CPU (Central Processing Unit) 11 (a time acquiring unit, a calculation unit, and a time setting acquiring unit), a ROM (Read Only Memory) 12, a RAM (Random Access Memory) 13, a power source unit 14, an operation unit 15, a hand driving unit 16, a gear train mechanism 17, hands 18, an oscillation circuit 19, a frequency dividing circuit 20, a timing circuit 21, a radio-wave receiving unit 22 as a receiving unit, and an antenna 23.

The CPU 11 performs a variety of calculations and comprehensively controls the entire operations of the electronic timepiece 1. The CPU 11 decodes and decrypts a time code signal acquired by demodulating the received standard time radio wave, and acquires time information and information about whether daylight saving time is in effect (hereinafter referred to as daylight-saving-time implementation information)

The ROM 12 stores a variety of control programs to be executed by the CPU 11 and setting data. The setting data includes a daylight-saving-time setting table 12*a* (an area setting storage unit). The daylight-saving-time setting table 12*a* includes various pieces of setting data (predetermined information), such a information to make settings for daylight saving time (daylight-saving-time setting information) for each city, the local time of which can be displayed with the electronic timepiece 1. Alternatively, the ROM 12 may be a rewritable non-volatile memory, such as EEPROM (Electrically Erasable and Programmable Read Only Memory) or a flash memory, and may allow rewriting when the setting is changed. The RAM 13 provides a work memory space for the CPU 11, and stores temporary data therein. The RAM 13 stores information of time difference of a city which a user selects to display the time thereof; a transmitting station to transmit the standard time radio wave; city setting data 13*a* (a time setting storage unit), such as settings for daylight saving time; and a DST flag 13*b* indicating whether the current time is daylight saving time.

The power source unit 14 supplies power to the CPU 11. The power source unit 14 may be, for example, a combination of a solar battery and a rechargeable battery, but is not particularly limited thereto.

The operation unit is composed of a button switch provided on the side of the electronic timepiece 1 such as a wristwatch. When the CPU 11 determines that the switch is pushed, the electronic timepiece 1 shifts into a mode where various settings are to be made. More specifically, the settings include a setting for a city (time zone) whose time is to be displayed by moving the hands 18; or a setting as to whether the switching between daylight saving time and standard time is to be performed automatically or manually.

The hands 18, which are composed of an hour hand, a minute hand, and a second hand, for example, are used to indicate time and indicate the settings associated with various functions. The hands 18 are driven by the hand driving unit 16 through the gear train mechanism 17. Specifically, driving pulses are input to the hand driving unit 16 from the CPU 11, which causes gears constituting the gear train mechanism 17 to rotate by predetermined angles, respectively, to move the hands 18 on a dial plate 24. Each of the plural hands may be driven by a separate hand driving unit, or alternatively, the minute hand and the hour hand, for example, may be driven by one hand driving unit in conjunction with each other. Further, the hands 18 may also include a function hand and/or a date indicator, in addition to the three hands described above. The function hand indicates a mode or a numerical value associated with various functions, and the date indicator indicates a day of the week and a date by selectively exposing characters/symbols/numbers written on the surface a disk through a small window.

The oscillation circuit 19 generates a predetermined frequency signal to output the signal to the frequency dividing circuit 20. The frequency dividing circuit 20 converts the frequency signal input from the oscillation circuit 19 into a 1 Hz signal or into a signal having another frequency to be used by the CPU 11, and outputs the converted signal to the CPU 11 and the timing circuit 21. The timing circuit 21 acquires the 1 Hz signal from the frequency dividing circuit 20 and counts the number of the inputs of the 1 Hz signal. Thus, the timing circuit 21 holds data of a current time while updating the time every second. The data of a current time held by the timing circuit 21 can be overwritten based on a control signal output from the CPU 11 when current time information is acquired from external to correct the time.

The radio-wave receiving unit 22 includes a receiving circuit to receive a long-wave radio with the antenna 23, and includes a demodulating circuit to demodulate the received radio wave. On the basis of the settings for a city included in the city setting data 13*a*, the CPU 11 sets the frequency of the radio wave, which is received and demodulated, to the frequency of the standard time radio wave that is transmitted from the transmitting station for the relevant city. The electronic timepiece 1 of the present embodiment can set the transmitting station to: JJY 40 (40 kHz) transmitted from Fukushima prefecture in Japan; JJY 60 (60 kHz) transmitted from the border between Saga and Fukuoka prefectures; WWVB (60 kHz) the United States; MSF (60 kHz) of Britain; DCF77 (77.5 kHz) of Germany; and the like.

Next, the process of acquiring the daylight-saving-time setting information will be described.

The electronic timepiece 1 according to the present embodiment makes settings for daylight saving time using both data of received standard time radio wave and the city setting data 13*a* which is set on the basis of the daylight-saving-time setting table 12*a*.

First, an output signal on the standard time radio wave will be explained. One 1-bit (binary) signal or 2-bit signal is output per second, and thereby, an array of sixty 1-bit signals or 2-bit signals constitutes the time code signal to be carried by the standard time radio wave. The format of the time code signal is prescribed for each transmitting station. Time information, such as information of minute, hour, day of the week, date, and year; and information of various settings including the daylight-saving-time implementation information can be acquired by decrypting (decoding) a time code based on the format. The sixty signals are output in such a way that the head of each signal synchronizes with each of 0 second to 59 seconds.

Next, the daylight-saving-time implementation information included in the time code will be explained.

In JJY 40 and JJY 60 of Japan, the output signals at 38 seconds and 40 seconds are set to be spare bits to be used for daylight saving time. Now a signal indicating "0" value is always output as the output signal at each of 38 seconds and 40 seconds. In WWVB of the United States, the output value "1" at 58 seconds indicates that daylight saving time is in effect, and the output value "0" at 58 seconds indicates that standard time is in effect. In MSF of Britain, the output value "1" for the B bit data (second bit) in the output signal at the 58 seconds indicates that daylight saving time is in effect, and the output value "0" therefor indicates that standard time is in effect. In DCF77 of Germany, the output vales "0" and "1" for 17 seconds and 18 seconds, respectively, indicate that standard time is in effect, and the output vales "1" and "0" at 17 seconds and 18 seconds, respectively, indicate that daylight saving time is in effect. Thus, when the standard time radio wave is to be received, the CPU 11 reads the format of a time code for each transmitting station from the ROM 12 based on the city setting data 13*a*. Then, the CPU 11 decodes the time code signal demodulated by the radio-wave receiving unit 22. Thereby, information about whether daylight saving time is in effect in each area can be acquired. Each of the value at 57 seconds in the time code of WWVB and the B bit data at 53 seconds in the time code of MSF indicates preliminary notice of switching between daylight saving time and standard time. Specifically, the output value is changed at these seconds, a predetermined period of time before the switching.

Next, the daylight-saving-time setting table 12*a* held in the electronic timepiece 1 will be explained.

FIG. 2 illustrates setting data for some cities extracted from the daylight-saving-time setting table 12*a* stored in the ROM 12.

The daylight-saving-time setting table 12*a* stores names of settable cities and information of settings for daylight saving time for the respective cities, each of the names and information being associated with each other. The table 12*a* shows that, in London, daylight saving time starts (STD,DST) on one o'clock on the last Sunday of March, and ends (DST-STD) on two o'clock on the last Sunday of October. The table 12*a* also shows that Tokyo does not use daylight saving time. The daylight-saving-time setting table 12*a* stores not only information of settings associated with daylight saving time, but also other information associated with settings for each city. More specifically, the daylight-saving-time setting table 12*a* also stores information of time difference from UTC (Universal Time Coordinated) of each city, information of whether to receive the standard time radio wave, or information of settings for a transmitting station to transmit the receivable standard time radio wave.

In the electronic timepiece 1 of the present embodiment, a city, whose time is to be displayed, can be selected by input operation through the operation unit 15. Various pieces of information for the selected city are acquired from the daylight-saving-time setting table 12*a* and stored in the city setting data 13*a*. At this time, the information such as "the last Sunday" is converted into data of a specific date. In a timing process, information of start/end of daylight saving time in a selected city can be acquired by referring to the city setting data 13*a*, and thus, it is not necessary to receive the standard time radio wave for acquiring such information.

For each city shown in FIG. 2, the initial setting for DST setting is "auto", which means that displayed time is switched between daylight saving time and standard time automatically when daylight saving time starts or ends. This may, however, cause a problem because whether daylight saving time is used or not differs depending on the city. Specifically, for example, although both Sydney and Brisbane in Australia are located in the same time zone, Sydney uses daylight saving time while Brisbane does not use it. Accordingly, when the electronic timepiece 1, which is automatically switched to daylight saving time in accordance with the setting for Sydney, is used in Brisbane, wrong time is displayed. In view of the circumstances, the electronic timepiece 1 can make a setting so that the switching to the daylight saving time is not performed automatically. That is, DST setting can be changed to "manual", and the electronic timepiece 1 can continue to display standard time. This enables the electronic timepiece 1 to display appropriate time for each city.

Further, the electronic timepiece 1 can make a setting so that the electronic timepiece 1 does not receive the standard time radio wave. For example, in Lima, Peru, which is located in the same time zone as New York, WWVB radio wave is not available. In such a case, fruitless repeated attempt to receive the standard time radio wave can be avoided, resulting in reducing power consumption.

Next, the concrete operation procedure for switching time to be executed by the electronic timepiece 1 of the present embodiment will be explained.

Figure 3:
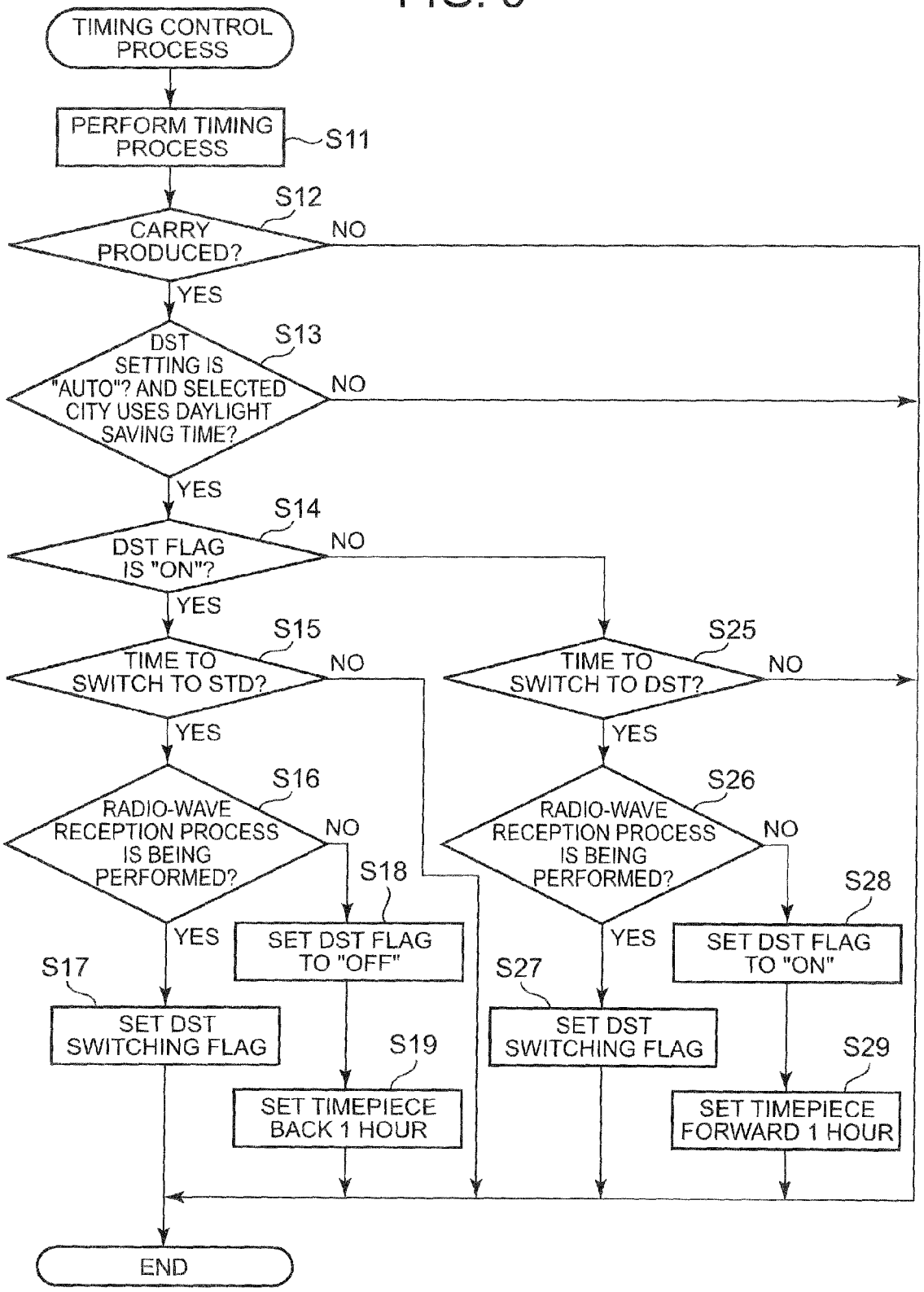
FIG. 3 is a flowchart illustrating a control procedure for a timing control process to be executed by a CPU.

FIG. 3 is a flowchart illustrating a control procedure for a timing control process to be executed by the CPU 11.

The timing control process is invoked and performed each time a signal indicating update of the current time is inputted from the timing circuit 21 every second.

First, the CPU 11 performs timing process where the CPU 11 outputs command to the hand driving unit 16 to drive the hands 18 based on current time data inputted from the timing circuit 21 (Step S11).

Next, the CPU 11 determines whether the inputted current time produces a carry (Step S12). In other words, the CPU 11 determines whether the current time is on the hour sharp (0 minute 0 second past 0 o'clock, 1 o'clock, 2 o'clock, . . . , and 23 o'clock). If the CPU 11 determines that the current time is not on the hour sharp, the process branches to "NO", and the CPU 11 ends the timing control process.

On the other hand, if the CPU 11 determines that the current time is on the hour sharp, the CPU 11 determines whether the selected city uses daylight saving time and whether the DST setting is set to "auto" (Step S13). More specifically, the CPU 11 refers to the city setting data 13*a* to determine whether each of the settings for "STD→DST" and "DST→STD" indicates "no setting", and whether the DST setting is set to "auto". If it is determined that the selected city does not use daylight saving time or determined that the DST setting is not set to "auto" but is set to "manual", the CPU 11 ends the timing control process.

If it is determined in Step S13 that the selected city uses daylight saving time and determined that DST setting is set to "auto", the CPU 11 further determines whether a DST flag is "ON" (Step S14), which DST flag indicates whether the currently-displayed time is daylight saving time. If it is determined that the DST flag is "ON", which indicates that the currently-displayed time is daylight saving time, the CPU 11 subsequently determines whether the current time is the time to switch from daylight saving time (DST) to standard time (STD) (Step S15). If it is determined that the current time is not the time to switch from daylight saving time to standard time, the CPU 11 ends the timing control process. If it is determined that the current time is the time to switch from daylight saving time to standard time, the CPU 11 determines whether the standard time radio wave is being received (Step S16). If it is determines that the standard time radio wave is being received, the CPU 11 sets a DST switching flag (sets the DST switching flag to "ON") (Step S17), and ends the timing control process. On the other hand, if it is determined that the standard time radio wave is not being received, the CPU 11 sets the DST flag to "OFF" (Step S18), and sets the electronic timepiece 1 back one hour from the currently-displayed time in accordance with standard time (Step S19). Then, the CPU 11 ends the timing control process.

If it is determined in Step S14 that the DST flag is not "ON", i.e., the DST flag is "OFF", the CPU 11 determines that the current time is the time to switch from standard time to daylight saving time (Step S25). If it is determined that the current time is not the time to switch from standard time to daylight saving time, the CPU 11 ends the timing control process. If it is determined that the current time is the time to switch from standard time to daylight saving time, the CPU 11 determines whether the standard time radio wave is being received (Step S26). If it is determined that the standard time radio wave is being received, the CPU 11 sets the DST switching flag (sets the DST switching flag to "ON") (Step 27), and ends the timing control process. On the other hand, if it is determined that the standard time radio wave is not being received, the CPU 11 sets the DST flag to "ON" (Step S28), and sets the electronic timepiece 1 forward one hour from the currently-displayed time in accordance with daylight, saving time (Step S29). Then, the CPU 11 ends the timing control process.

Next, the case in which the time to switch to daylight saving time comes during or immediately before or after a radio-wave reception process will be explained.

FIG. 4 shows the cases in which radio-wave reception is performed at or immediately before or after the time of switching to daylight-saving-time setting, and shows the process to be performed in each case. FIG. 4 shows, as an example, the process performed in the following conditions: the electronic timepiece 1 starts the process for receiving the standard time radio wave at 30 seconds every minute immediately before or after the start of daylight saving time; the timing of the head of each second and the timing of the minute sharp (0 second) are acquired in the first 30 seconds; data of t me code for two cycles is acquired in two minutes; the time is corrected 10 seconds after he acquisition of the two-cycle data; and the process for receiving the standard time radio wave ends.

In the case where the radio-wave reception process starts at 56 minutes 30 seconds, i.e., 3 minutes 30 seconds before the start of daylight saving time, the whole reception process and time correction process are completed by 59 minutes 10 seconds, which is before the start of daylight saving time. In this case, the time is not switched to daylight saving time during the radio-wave reception process, and thus, the DST switching flag remains "OFF". The DST flag also remains "OFF". In this case, it is not necessary to perform an additional process. At 0 minute 0 second (on the hour sharp), the time is switched to daylight saving time through the timing control process described above.

In the case where the radio-wave reception process starts at 57 minutes 30 seconds, i.e., 2 minutes 30 seconds before the start of daylight saving time, the time is corrected at 0 minute 10 seconds, which is after the start of daylight saving time. Since the time to switch to daylight saving time comes before completion of the radio-wave reception process, the DST switching flag is "ON" when radio-wave reception process has been completed. The time code acquired through the radio-wave reception process is the data in the 58-minute range and 59-minute range, which is before the start of daylight saving time. Accordingly, the time is corrected based on standard time, i.e., the time before the start of daylight saving time, and thus, the DST flag remains "OFF". In this case, therefore, it is required that the DST switching flag be switched to "OFF", the DST flag be switched to "ON", and the displayed time be corrected to daylight saving time.

In the case where the radio-wave reception process starts at 58 minutes 30 seconds, i.e., 1 minute 30 seconds before the start of daylight saving time, the decrypted first-cycle time code is a time code provided before the start of daylight saving time, and the decrypted second-cycle time code is a time code provided after the start of daylight saving time. As a result, the difference between the first-cycle time code and the second-cycle time code is not 1 minute, leading to a decryption error. Accordingly, it is determined that the radio-wave reception process has failed, and the process ends without correcting time. In this case, the DST switching flag is switched to "ON" at 0 minute past 0 during the radio-wave reception process, while the DST flag remains "OFF". In this case, therefore, it is required that the DST switching flag be switched to "OFF", the DST flag be switched to "ON", and the displayed time be corrected to daylight saving time.

The electronic timepiece 1 may perform a process so to read the setting information for daylight saving time from the standard time radio wave, and to properly recognize the jump of one hour between before and after the start of daylight saving time. In such a case, the time is corrected based on daylight saving time at 1 minute 10 seconds, and the DST flag is switched to "ON". Therefore, the process for this case is similar to that for the case where the radio-wave reception process starts at 59 minutes 30 seconds, which is described later.

In the case where the radio-wave reception process starts at 59 minutes 30 seconds, each of the decrypted time codes for two cycles is the time code provided after the start of daylight saving time. The time is corrected at 2 minutes 10 seconds based on daylight saving time. The DST switching flag is switched to "ON" at 0 minute 0 second during the radio-wave reception process, and the DST flag is switched to "ON" in correcting the time. Accordingly, after the radio-wave reception process has been completed, it is only necessary to set the DST switching flag back to "OFF".

In the case where the radio-wave reception process starts at 0 minutes 30 seconds, which is after the start of daylight saving time, each of the decrypted time codes for two cycles is the time code provided after the start of daylight saving time. The time is corrected at 3 minutes 10 seconds based on daylight saving time. Since the radio-wave reception process does not coincide with the start of daylight saving time, the DST switching flag remains "OFF". The DST flag is already switched to "ON" and the displayed time is already switched to daylight saving time in the timing process at 0 minute 0 second before the start of the radio-wave reception process. Accordingly, it is not necessary to perform an additional process after the radio-wave reception process has been completed.

As described above, in the case where the electronic timepiece 1 is switched to daylight saving time while the process for receiving the standard time radio wave is being performed, causing the DST switching flag to be switched to "ON", an additional process is performed as appropriate when the radio-wave reception process has been completed depending on whether the radio wave has been properly received, and whether the electronic timepiece 1 is switched to daylight saving time on the basis of the time acquired through decryption of a time code.

Figure 5:
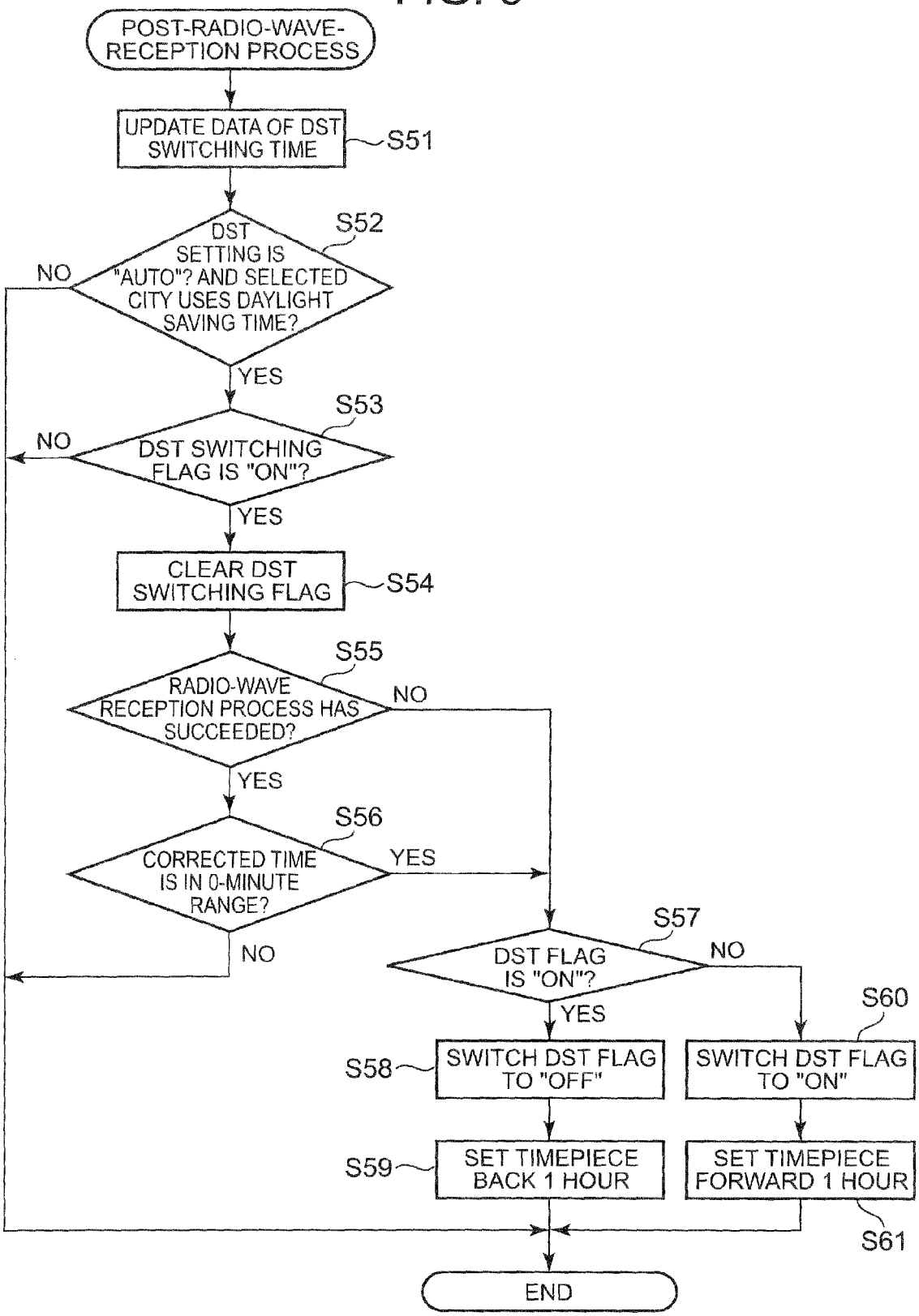
FIG. 5 is a flowchart illustrating a control procedure for a process to be performed by the CPU when the radio-wave reception process is completed.
Figure 6:
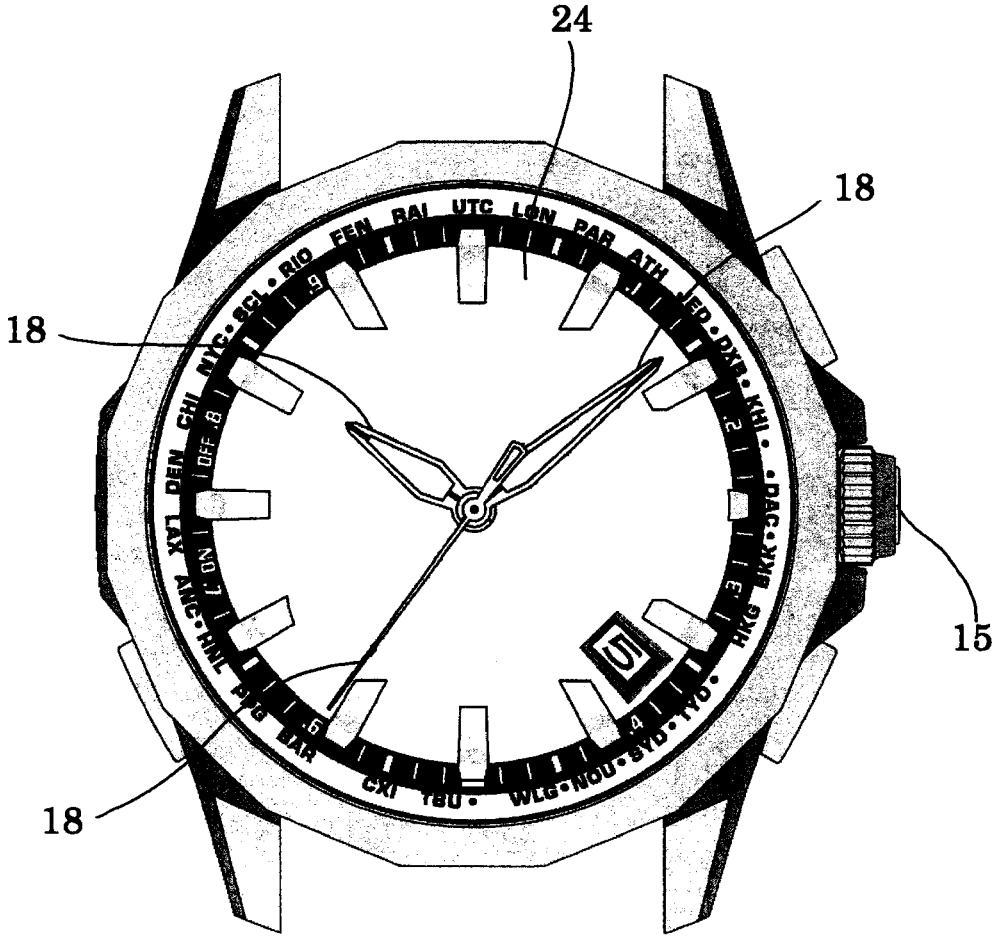
FIG. 6 is a plan view of the electronic timepiece.

FIG. 5 is a flowchart illustrating a control procedure for a process to be performed by the CPU 11 when the radio-wave reception process is completed (herein after referred to as post-radio-wave-reception process). This process is automatically invoked and performed immediately after the radio-wave reception process is completed.

When the post-radio-wave-reception process is invoked, the CPU 11 updates the data of DST switching time stored in the city ting data 13*a* based on the current time data acquired from the timing circuit 21 (Step S51). Then, the CPU 11 refers to the updated city setting data 13*a* and determines whether the DST setting is set to "auto" and whether the selected city uses daylight saving time (Step S52). When it is determined that the DST setting is not set to "auto" but is set to "manual", or determined that the selected city does not use daylight saving time, the CPU 11 ends the post-radio-wave-reception process. If it is determined that the DST setting is set to "auto" and determined that the selected city uses daylight saving time, the CPU 11 determines whether the DST switching flag is set to "ON" (Step S53). If it is determined that the DST switching flag is not set, i.e., the DST switching flag is "OFF", the CPU 11 ends the post-radio-wave-reception process.

If it is determined that the DST switching flag is set, the CPU 11 clears the DST switching flag to be "OFF" (Step S54). Then, the CPU 11 determines whether the radio-wave reception process has succeeded and whether the time data has been acquired (Step S55). If it is determined that the radio-wave reception process has failed, the process goes on to Step S57. If it is determined that the radio-wave reception process has succeeded, the CPU 11 subsequently determines whether the corrected time is in the 0-minute range as a result of the radio-wave reception process (Step S56). If it is determined that the corrected time is not in the 0-minute range, the CPU 11 ends the post-radio-wave-reception process. If it is determined that the corrected time is in the 0-minute range, the process goes on to Step 557.

When the process proceeds to Step S57, the CPU 11 determines whether the DST flag is "ON". If it is determined that the DST flag is "ON", the CPU 11 switches the DST flag to "OFF" (Step S58), and sets the electronic timepiece 1 back one hour from the currently-displayed time in accordance with standard time (Step S59). Then, the CPU 11 ends the post-radio-wave-reception process. Or the other hand, if it is determined that the DST flag is "OFF" in Step S57, the CPU 11 switches the DST flag to "ON" (Step S60), and sets the electronic timepiece 1 forward one hour from the currently-displayed time in accordance with daylight saving time (Step S61). Then, the CPU 11 ends the post-radio-wave-reception process.

As described above, the electronic timepiece 1 of the present embodiment includes the timing circuit 21, the radio-wave receiving unit 22, the antenna 23, and the daylight-saving-time setting table 12*a*. The radio-wave receiving unit 22 and the antenna 23 receive the standard time radio wave. The daylight-saving-time setting table 12*a* stores a time difference, a transmitting station to transmit the receivable standard time radio wave, and predetermined information about the time, such as the time to start/end daylight saving time, of each of the preset cities. The CPU decodes a time code demodulated from a received standard time radio wave in the format unique to a preset transmitting station of the standard time radio wave, and acquires current time data and daylight-saving-time implementation information. The electric timepiece 1 outputs the current time of a selected city using the current time data, the daylight-saving-time implementation information, and the predetermined information. Accordingly, a user does not need to make settings manually for daylight saving time in order to get the current time reflecting the daylight-saving-time implementation information of the selected city. Further, the user can get the current time reflecting the daylight-saving-time implementation information of the selected city without a time lag more than a few minutes in the case where the time to start or end of daylight saving time stored in the daylight-saving-time setting table 12*a* comes while the process for receiving the standard time radio wave is being performed, an additional process is performed as appropriate after the radio-wave reception process is completed. Accordingly, when the reception of standard time radio wave has failed, or when the time data acquired through the reception of standard time radio wave is the time data provided before the start or end of daylight saving time, the additional process, i.e., the process to start or end daylight saving time based on the settings in the daylight-saving-time setting table 12*a* is performed. Thus, even when the current daylight-saving-time implementation information is not acquired from the standard time radio wave, the daylight saving-time implementation information can be updated without delay. Further, even when the actual daylight-saving-time implementation information Is changed from the settings in the daylight-saving-time setting table 12*a*, appropriate daylight-saving-time implementation information can be set based on the information acquired from the standard time radio wave.

In other words, by combining acquisition of the daylight-saving-time implementation information through the reception of standard time radio wave and acquisition of the daylight-saving-time setting information from the daylight-saving-time setting table 12*a*, the start or end daylight saving time can be reflected without delay even when the reception of standard time radio wave has failed or when there is some time from the start or end of daylight saving time until the next reception of standard time radio wave.

The electronic timepiece 1 includes the operation unit 15 and the daylight-saving-time setting table 12*a* storing predetermined information for a plurality of cities. Further, the electronic timepiece 1 acquires setting data of a city selected by an input operation through the operation unit 15, and stores the acquired setting data in the city setting data 13*a*. Therefore, even if a user moves among a plurality of cities, the user can easily acquire time information reflecting whether daylight saving time is in effect in the city where the user is staying. Thus, the user can acquire an accurate current time of each city.

Further, the predetermined information includes not only the daylight-saving-time setting information but also time difference information for a selected city, information of station to transmit the standard time radio wave that is receivable in the selected city, and time difference information for the time transmitted from the station. Therefore, the time information acquired from the standard time radio wave can easily be converted into a current time of the selected city.

Information of the time to start or end daylight saving time is conventionally stored as the information of "the second Sunday", "the last Sunday", or the like. The electronic timepiece 1 of the present embodiment converts such information into data of actual dates when storing the time to start or end daylight saving time for a selected city in the city setting data 13*a*.

Therefore, in the timing process, it can more easily be de e mined whether the time to start or end daylight saving time has come or not.

Even if located in the same time zone, some cities use daylight saving time and others do not use it. In view of this, the electronic timepiece 1 of the present embodiment can make a setting, by an input operation through the operation unit 15, so that the acquired daylight-saving-time implementation information and daylight-saving-time setting information are not reflected in the displayed time, depending on the information of implementation status of daylight saving time in a first city where the electronic timepiece 1 is currently located, information of a transmitting station that transmits the standard time radio wave, and information of implementation status of daylight saving time in a second city located in the same time zone as the first city included in the daylight-saving-time setting table 12*a*.

Further, even if a user is not good at making complicated settings, the user can easily and quickly know a current time reflecting daylight saving time around the world by applying the settings for daylight saving time described above to an analog timepiece.

Further, if daylight saving time starts or ends while the process for receiving the standard time radio wave is being performed, and if a newly-set time after completion of the reception of standard time radio wave is in the 0-minute range, it is determined that the time acquired from the standard time radio wave does not reflect the information of the start/end of daylight saving time, and then, the information is immediately reflected in the current time data. Therefore, the daylight-saving-time implementation information can appropriately be updated without complicated processes.

The present invention is not limited to the above-described embodiment, but may be modified in various ways. For example, the current time data reflecting daylight saving time in a selected city may be directly kept by the timing circuit 21. Alternatively, timekeeping may be performed according to the UTC or the standard time of a selected hometown, and each time the CPU 11 outputs a current time, the CPU 11 may reflect time difference information and time difference information associated with implementation of daylight saving time for another city.

In the above-mentioned embodiment, the time code data is acquired for two cycles from 0 second to be decoded. Alternatively, the time code data may be acquired for two cycles from other midway timing. Further, the decoding may be performed in various publicly-known methods. The time information and the daylight-saving-time implementation information may be acquired based on the data of not for two cycles, but for another numbers of cycles.

Further, in the above-mentioned embodiment, whether the daylight-saving-time implementation information is acquired before or after the time of switching associated with daylight saving time is determined, depending on whether the current time that has been corrected based on the received standard time radio wave is in the 0-minute range. However, the time as a criterion for this determination may be changed. For example, in the case of JJY, the daylight-saving-time implementation information is acquired through acquisition of the data at 40 seconds. Accordingly, the electronic timepiece 1 can set the time to 0 minute 45 seconds, for example, as the criterion for the determination depending on the method of decoding. In the case of making settings for daylight saving time for a city whose time difference is 30 minutes or 45 minutes, the CPU 11 determines the time to acquire the daylight-saving-time implementation information whether the calculated times are in the 30-minute range and the 45-minute range, respectively.

In addition, the detailed configurations such as specific structures and process orders described in the embodiment above may be modified appropriately without deviating from the concept of the present invention.

The entire disclosure of Japanese Patent Application No. 2011-210169 filed on Sep. 27, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An electronic timepiece comprising:

a receiving unit that receives a standard time radio wave;

a time acquiring unit that acquires time information and daylight-saving-time implementation information indicating whether daylight saving time is currently in effect, from the standard time radio wave received by the receiving unit;

a time setting storage unit that stores predetermined information associated with a time in a preset area, the predetermined information including daylight-saving-time information relating to a start and end of daylight-saving-time in the preset area and indicating a time of switching to/from daylight saving time in the preset area; and a calculation unit that calculates a current time in the preset area based on the time information and the daylight-saving-time implementation information acquired by the time acquiring unit and based on the predetermined information stored in the time setting storage unit;

wherein:

when the time of switching arrives while a process for receiving the standard time radio wave is being performed, the calculation unit determines whether one of a first condition and a second condition is satisfied, the first condition being a condition in which reception of the standard time radio wave fails after completion of the process for receiving the standard time radio wave, and the second condition being a condition in which the daylight-saving-time implementation information acquired by the time acquiring unit is information provided before the time of switching; and when the calculation unit determines that one of the first condition and the second condition is satisfied, the calculation unit controls to switch a flag associated with whether the daylight saving time is in effect, to calculate the current time.

2. The electronic timepiece according to claim 1, further comprising:

an operation unit that receives an input operation by a user;

an area setting storage unit that stores the predetermined information in association with each of a plurality of areas; and a time setting acquiring unit that acquires the predetermined information associated with one area selected, through the operation unit, from among the areas stored in the area setting storage unit, and stores the acquired predetermined information in the time setting storage unit.

3. The electronic timepiece according to claim 2, wherein:

the predetermined information stored in the area setting storage unit includes information of a transmitting station to transmit the standard time radio wave that is receivable for each of the areas, first time difference information indicating a time zone of each of the areas, and second time difference information indicating a time zone for the time information to be broadcasted through the receivable standard time radio wave;

the receiving unit receives the standard time radio wave from the transmitting station for the receivable standard time radio wave; and the calculation unit calculates the current time using the time information, the daylight-saving-time implementation information, the daylight-saving-time setting information, the first time difference information, and the second time difference information.

4. The electronic timepiece according to claim 3, wherein:

the daylight-saving-time setting information stored in the area setting storage unit includes information of a month, a day of a week, a place of the day in the month, and a time of each of the start and the end of the daylight saving time; and the time setting acquiring unit calculates a date of each the start and end of the daylight saving time based on the daylight-saving-time setting information, and stores the calculated date in the time setting storage unit.

5. The electronic timepiece according to claim 4, wherein the calculation unit makes a setting, by a predetermined input operation through the operation unit, so that the current time is calculated without reflecting a switch associated with whether the daylight saving time is in effect, the switch being based on the daylight-saving-time implementation information and the daylight-saving-time setting information.

6. The electronic timepiece according to claim 5, further comprising:

a plurality of hands; and a dial plate having characters, symbols, or numbers thereon to be pointed to by the hands to indicate a time;

wherein:

the dial plate has characters, symbols, or numbers thereon representing the respective areas stored in the area setting storage unit; and a selected area, for which the current time is to be displayed, can be indicated, through the operation unit, in such a way that one of the hands points to one of the characters, symbols, or numbers representing the respective areas.

7. The electronic timepiece according to claim 4, further comprising:

a plurality of hands; and a dial plate having characters, symbols, or numbers thereon to be pointed to by the hands to indicate a time;

wherein:

the dial plate has characters, symbols, or numbers thereon representing the respective areas stored in the area setting storage unit; and a selected area, for which the current time is to be displayed, can be indicated, through the operation unit, in such a way that one of the hands points to one of the characters, symbols, or numbers representing the respective areas.

8. The electronic timepiece according to claim 3, wherein the calculation unit makes a setting, by a predetermined input operation through the operation unit, so that the current time is calculated without reflecting a switch associated with whether the daylight saving time is in effect, the switch being based on the daylight-saving-time implementation information and the daylight-saving-time setting information.

9. The electronic timepiece according to claim 8, further comprising:

a plurality of hands; and a dial plate having characters, symbols, or numbers thereon to be pointed to by the hands to indicate a time;

wherein:

the dial plate has characters, symbols, or numbers thereon representing the respective areas stored in the area setting storage unit; and a selected area, for which the current time is to be displayed, can be indicated, through the operation unit, in such a way that one of the hands points to one of the characters, symbols, or numbers representing the respective areas.

10. The electronic timepiece according to claim 3, further comprising:

a plurality of hands; and a dial plate having characters, symbols, or numbers thereon to be pointed to by the hands to indicate a time;

wherein:

the dial plate has characters, symbols, or numbers thereon representing the respective areas stored in the area setting storage unit; and a selected area, for which the current time is to be displayed, can be indicated, through the operation unit, in such a way that one of the hands points to one of the characters, symbols, or numbers representing the respective areas.

11. The electronic timepiece according to claim 3, wherein when the current time is in a 0-minute range between zero minutes and one minute, the current time being calculated based on the standard time radio wave received during a period including the time of switching, the calculation unit determines that the daylight-saving-time implementation information acquired by the time acquiring unit is the information provided before the time of switching.

12. The electronic timepiece according to claim 2, wherein:

the daylight-saving-time setting information stored in the area setting storage unit includes information of a month, a day of a week, a place of the day in the month, and a time of each of the start and end of the daylight saving time; and the time setting acquiring unit calculates a date of each of the start and end of the daylight saving time based on the daylight-saving-time setting information, and stores the calculated date in the time setting storage unit.

13. The electronic timepiece according to claim 12, wherein the calculation unit makes a setting, by a predetermined input operation through the operation unit, so that the current time is calculated without reflecting a switch associated with whether the daylight saving time is in effect, the switch being based on the daylight-saving-time implementation information and the daylight-saving-time setting information.

14. The electronic timepiece according to claim 13, further comprising:

a plurality of hands; and a dial plate having characters, symbols, or numbers thereon to be pointed to by the hands to indicate a time;

wherein:

the dial plate has characters, symbols, or numbers thereon representing the respective areas stored in the area setting storage unit; and a selected area, for which the current time is to be displayed, can be indicated, through the operation unit, in such a way that one of the hands points to one of the characters, symbols, or numbers representing the respective areas.

15. The electronic timepiece according to claim 12, further comprising:

a plurality of hands; and a dial plate having characters, symbols, or numbers thereon to be pointed to by the hands to indicate a time;

wherein:

the dial plate has characters, symbols, or numbers thereon representing the respective areas stored in the area setting storage unit; and a selected area, for which the current time is to be displayed, can be indicated, through the operation unit, in such a way that one of the hands points to one of the characters, symbols, or numbers representing the respective areas.

16. The electronic timepiece according to claim 2, wherein the calculation unit is operable such that, when a predetermined input operation is input through the operation unit, the current time is calculated without reflecting a switch associated with whether the daylight saving time is in effect, the switch being based on the daylight-saving-time implementation information and the daylight-saving-time setting information.

17. The electronic timepiece according to claim 16, further comprising:

a plurality of hands; and a dial plate having characters, symbols, or numbers thereon to be pointed to by the hands to indicate a time;

wherein:

the dial plate has characters, symbols, or numbers thereon representing the respective areas stored in the area setting storage unit; and a selected area, for which the current time is to be displayed, can be indicated, through the operation unit, in such a way that one of the hands points to one of the characters, symbols, or numbers representing the respective areas.

18. The electronic timepiece according to claim 2, further comprising:

a plurality of hands; and a dial plate having characters, symbols, or numbers thereon to be pointed to by the hands to indicate a time;

wherein:

the dial plate has characters, symbols, or numbers thereon representing the respective areas stored in the area setting storage unit; and a selected area, for which the current time is to be displayed, can be indicated, through the operation unit, in such a way that one of the hands points to one of the characters, symbols, or numbers representing the respective areas.

19. The electronic timepiece according to claim 2, wherein when the current time is in a 0-minute range between zero minutes and one minute, the current time being calculated based on the standard time radio wave received during a period including the time of switching, the calculation unit determines that the daylight-saving-time implementation information acquired by the time acquiring unit is the information provided before the time of switching.

20. The electronic timepiece according to claim 1, wherein when the current time is in a 0-minute range between zero minutes and one minute, the current time being calculated based on the standard time radio wave received during a period including the time of switching, the calculation unit determines that the daylight-saving-time implementation information acquired by the time acquiring unit is the information provided before the time of switching.

* * * * *